United States Patent [19]

Dennesen

[11] Patent Number: 4,803,922

[45] Date of Patent: Feb. 14, 1989

[54] TRANSFER PRINTING APPARATUS

[75] Inventor: Joseph C. Dennesen, 62 Bridge St., Beverly, Mass. 01915

[73] Assignees: Joseph C. Dennesen; Thomas C. Stover, both of Marblehead, Mass.

[21] Appl. No.: 803,414

[22] Filed: Dec. 2, 1985

Related U.S. Application Data

[63] Continuation-in-part of Ser. No. 431,354, Sep. 30, 1982, abandoned.

[51] Int. Cl.[4] ..... B41F 17/00

[52] U.S. Cl. ..... 101/41; 101/169; 101/401; 101/406; 101/492; 101/DIG. 36; 101/DIG. 40

[58] Field of Search ..... 101/426, 33–35, 101/359–372, 41–44, 405–406, 161, 151, 368, 401, DIG. 17, DIG. 12; 33/184.5, 184.6

[56] References Cited

U.S. PATENT DOCUMENTS

| | | | |
|---|---|---|---|
| 15,764 | 9/1856 | Hackett | 101/41 X |
| 418,236 | 12/1889 | Schulze-Berge | 101/41 |
| 778,386 | 12/1904 | Tenney | 101/373 |
| 1,537,685 | 5/1925 | Ladd | 101/DIG. 17 |
| 2,235,820 | 3/1941 | Humphries | 101/41 |
| 2,561,947 | 7/1951 | Premo | 101/41 |
| 2,616,368 | 11/1952 | Hochman | 101/41 |
| 2,748,696 | 6/1956 | Murray | 101/41 |
| 2,791,052 | 5/1957 | Vasel | 101/401 X |
| 2,839,994 | 6/1958 | Hagg | 101/109 X |
| 3,793,442 | 5/1957 | Ozga | 33/184.5 |
| 4,019,436 | 4/1977 | Hanidweiler et al. | 101/41 |
| 4,060,031 | 11/1977 | Philipp | 101/41 |
| 4,163,421 | 8/1979 | Sihota | 101/41 |
| 4,314,503 | 2/1982 | Perra et al. | 101/41 |
| 4,392,425 | 7/1983 | Capezzuto et al. | 101/405 |

FOREIGN PATENT DOCUMENTS

| | | | |
|---|---|---|---|
| 709618 | 7/1941 | Fed. Rep. of Germany | 101/368 |
| 2501221 | 7/1975 | Fed. Rep. of Germany | 101/44 |
| 582859 | 10/1958 | Italy | 101/41 |
| 498237 | 1/1939 | United Kingdom | 101/41 |
| 748412 | 5/1953 | United Kingdom | 101/41 |
| 837481 | 6/1960 | United Kingdom | 101/41 |
| 881945 | 11/1961 | United Kingdom | 101/41 |

*Primary Examiner*—E. H. Eickholt

*Attorney, Agent, or Firm*—Thomas C. Stover, Jr.

[57] ABSTRACT

The present invention provides method and apparatus for printing a pattern on articles employing a printing plate having a grooved pattern therein in which ink is applied to such plate and a scraper blade passes thereover to remove the excess ink from the plate surface while leaving such ink in the grooves. An apertured shield can be placed over the scraped plate, the aperture positioned to expose the grooved pattern. A transfer printing pad is then contacted with the so-shielded grooved plate and picks up the ink pattern. The so-inked transfer pad is then contacted with an article to print the inked pattern thereon. In some embodiments, the apertured shield is omitted.

Desireably the printing pad is resiliently mounted on a plunger having means to index its position over the inked and scraped grooved plate and then such plunger is indexed on a holder of the article to be printed to permit precise ink pick-up and transfer printing of articles employing one or more ink transfer and indexing steps to print a precise pattern of letters and/or designs on one or more lines, in one or more colors. Further such printing apparatus can readily be operated by hand.

41 Claims, 12 Drawing Sheets

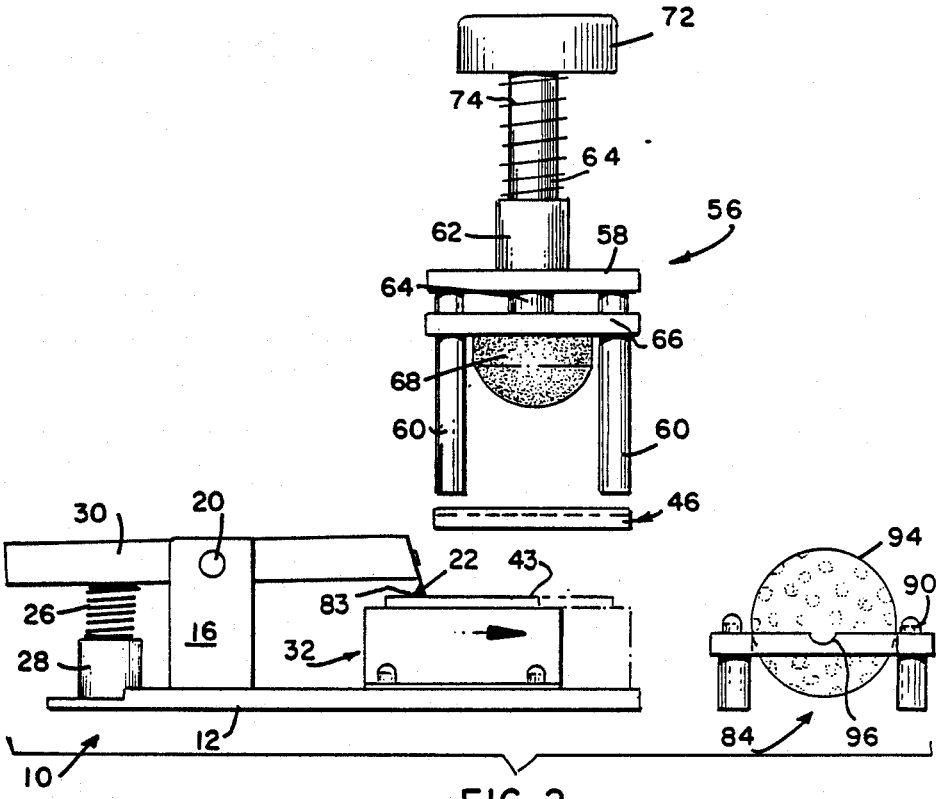
FIG. 2
FIG. 3
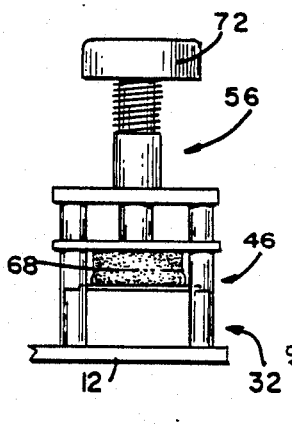
FIG. 4
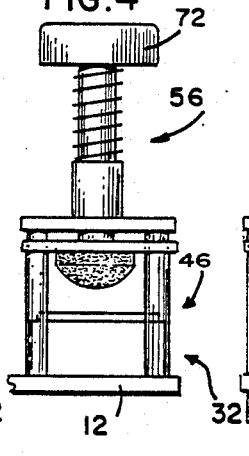
FIG. 5
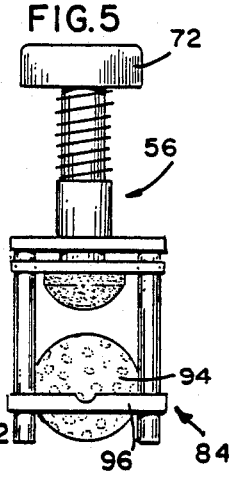
FIG. 6
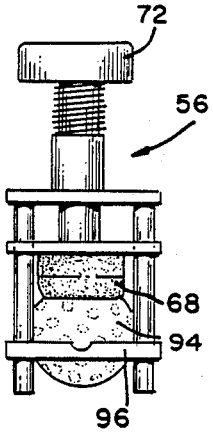

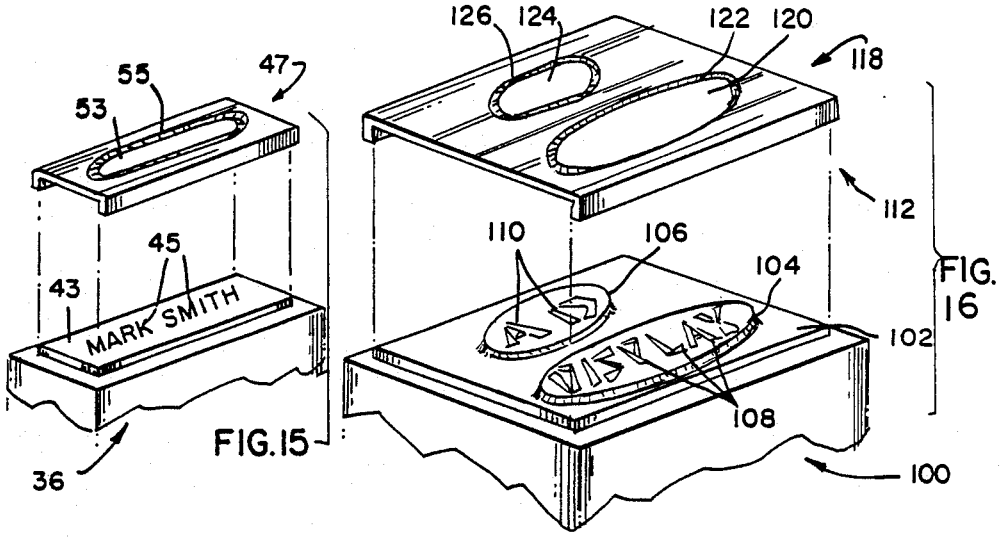
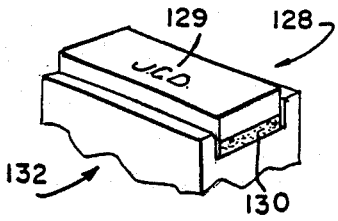
FIG.17
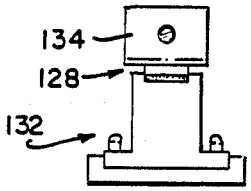
FIG.18
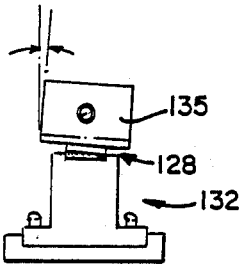
FIG.19
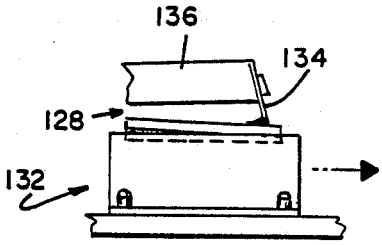
FIG. 20
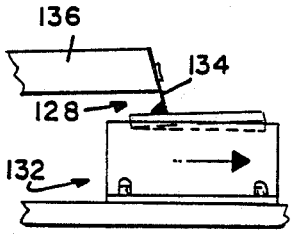
FIG. 21

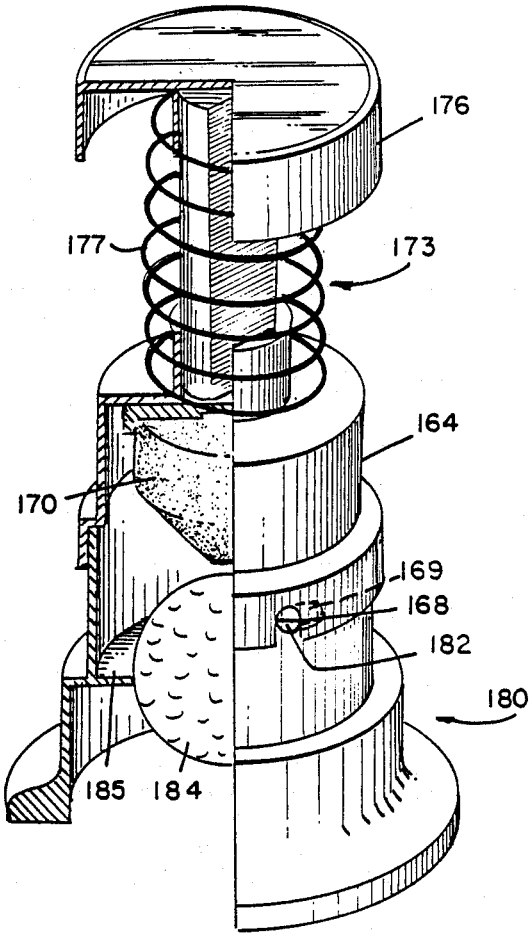
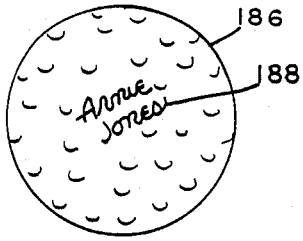
FIG. 23

TRANSFER PRINTING APPARATUS

This application is a continuation-in-part of U.S. application Ser. No. 431,354 filed 9-30-82 and now abandoned.

BACKGROUND OF THE INVENTION

FIELD OF THE INVENTION

This invention relates to printing articles, particularly an apparatus for transfer printing of articles.

THE PRIOR ART

Transfer printing of articles by pick-up of an ink pattern on a flexible pad and subsequent transfer to the article is known. One commercial embodiment uses compressed air and solenoids to move a staging back and forth over a table holding a grooved ink plate and the article to be printed upon. The staging holds an ink scraping blade and a flexible ink pick-up pad, all of which are moved back and forth and up and down over a stationary table in a complicated and expensive apparatus. As indicated, such staging moves back and forth and up and down by air pressure hydraulics and electric solenoids and is subject to breakdown and repair problems. Accordingly there is a need and market for an improved article printing apparatus which is of uncomplex construction and which substantially obviates the above prior art shortcomings.

There has now been discovered an article printing apparatus which is of simplified construction, which does not require compressed air or solenoids for operation, which employs an improved, more versatile operating mechanism than previously available and which in some embodiments, can be operated by hand.

SUMMARY

Broadly, the present invention provides an apparatus for printing a pattern on articles comprising: (a) a surface having a pattern embossed thereon;(b) means to apply printing material to said surface including on the embossed pattern; (c) a removal member; (d) means to move said surface relative to and in contact with said removal member to remove material from said surface while leaving said printing material on said embossed pattern; (e) a transfer member; (f) means to contact said transfer member with the printing material on said embossed pattern to pick up the so-patterned printing material and (g) means for contacting said transfer member with an article to print said pattern on said article.

Also provided is a method for printing a pattern on articles comprising; (a) applying printing material on a surface having a pattern embossed thereon; (b) removing said printing material from said surface while leaving said printing material on said embossed pattern; shielding said surface while exposing said embossed pattern; (d) contacting said embossed pattern with a printing material pick-up surface to pick up said printing material in a pattern and (e) contacting said pick-up surface and said pattern with an article to print said pattern on said article.

Broadly the present invention further provides a printing apparatus for printing a pattern on articles comprising: a holder having a transfer pad mounted thereon, a member having a three-dimensional pattern thereon and means to apply printing material to the pattern. Means are further provided to contact the pad with the pattern to pick up the so-patterned printing material on the pad as are means for contacting the pad with an article to print the pattern on the article.

In some embodiments the pattern, pad and article holder have indexing means for reproducibly indexing of pattern with pad and pad with article.

Also provided is a method for printing a pattern on two and three dimensional articles comprising applying printing material to a three-dimensional pattern, contacting the pattern with a transfer pad to pick up the so-patterned printing material on the pad and contacting the pad with an article to print the pattern on the article.

By "embossed surface" or "embossed pattern" as used herein, is meant a raised or grooved pattern on or in such surface or a combination thereof.

By "three-dimensional pattern" as used herein, is meant raised or grooved pattern on or in a surface or a combination thereof.

The printing material herein can be any suitable printing material, including dyes or ink, which material is applied to the embossed surface by any suitable means, e.g. by brushing, pouring, daubing, coating and the like.

BRIEF DESCRIPTION OF THE DRAWINGS

The invention will become more apparent from the following detailed Specification and drawings in which;

FIG. 2 is a side elevation view of the apparatus of FIG. 1, in operation;

FIG. 3 is an elevation view of components of the apparatus of FIG. 2 at one stage of operation.

FIG. 4 is an elevation view of components of FIG. 3, at another stage of operation;

FIG. 5 is an elevation view which includes other components of the apparatus of FIG. 2, at a further stage of operation;

FIG. 6 is an elevation view of the components of FIG. 5, at another stage of operation;

FIG. 15 is a perspective view of a portion of other components of the apparatus of the present invention;

FIG. 16 is a perspective view of a portion of still other components of the apparatus embodying the present invention;

FIG. 17 is a perspective view of another embodiment of a component of the present invention;

FIGS. 18 and 19 are elevation views of assembled components of the apparatus of the invention including the component of FIG. 17;

FIG. 20 is a partial sectional elevation view of the apparatus embodying the invention including the component shown in FIG. 18 or 19 at one stage of operation;

FIG. 21 is a partial sectional elevation view of the portion of the apparatus embodying the invention shown in FIG. 20 at another stage of operation;

FIG. 23 is a perspective view of the printer of FIG. 22 mounted at another stage of operation thereof;

DESCRIPTION OF PREFERRED EMBODIMENT

Figure 1:
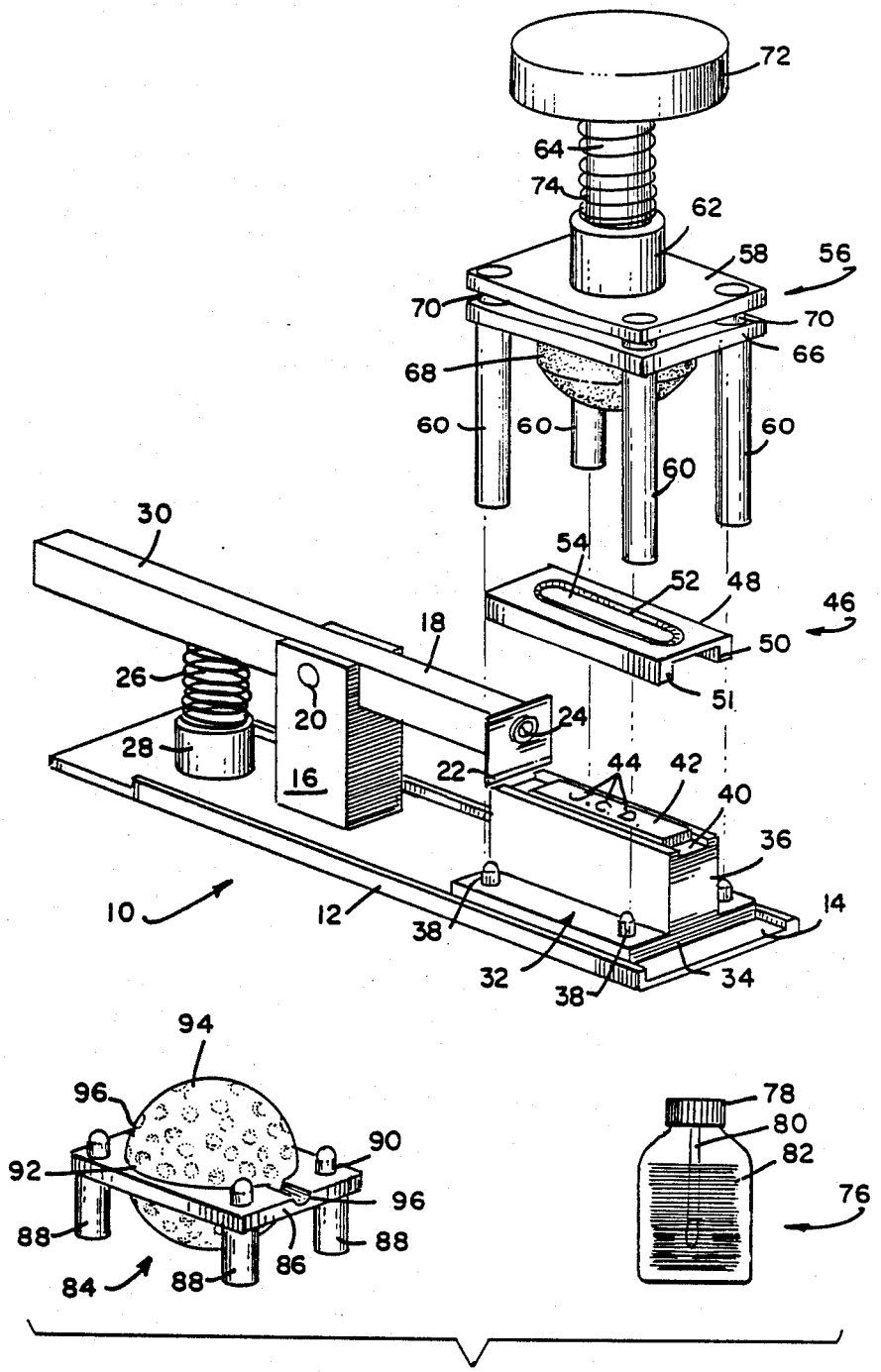
FIG. 1 is a perspective view of a printing apparatus embodying the present invention.

Referring in detail to the drawings, the article printer 10 has a base 12 which defines a channel 14, a pedestal 16, a scraper arm 18, which pivots on pivot pin 20 and a scraper blade 22, mounted to said arm by screw 24, as shown in FIG. 1. A helical spring 26 mounted on base post 28, on the base 12, contacts the after end 30 of the scraper arm 18 and resiliently pivots such arm and urges the scraper or doctor blade 22 downwardly, as indicated in FIGS. 1 and 2.

Mounted in the channel 14 of the printer 10 is printing plate support member 32, having base 34, upstanding plate support block 36 and four indexing projections or pins 38 as shown in FIGS. 1, 2, 8, and 9.

Mounted in a minor channel 40, atop the plate support block 36, is a cliche or printing plate 42, having a pattern 44, embossed therein, as shown in FIG. 1. The embossed pattern can take the form of a raised or grooved pattern applied to the surface of the plate by various means known in the art and in this example, takes the form of three letters, "J C D", grooved in the surface of the plate 42, e.g. where such plate is of metal e.g. by etching such letters, as shown or indicated in FIGS. 1 and 8.

Figure 10:
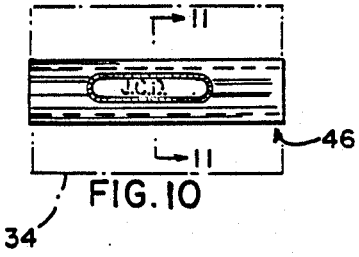
FIG. 10 is a plan view of components of the invention shown in FIGS. 1 and 2.
Figure 11:
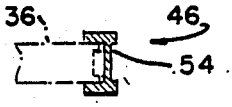
FIG. 11 is a fragmentary sectional elevation view of the components of FIG. 10, taken on lines 11—11, looking in the direction of the arrows.

Mountable over the plate 42 and over the top portion of the plate support block 36 is a shield 48, having a slot or aperture 52 therein, which shields or covers a portion of the surface of the plate 42, and at least a portion of the plate perimeter while exposing the embossed pattern 44 in the aperture 52 of such shield, as shown or indicated in FIGS. 1, 10, and 11. Preferably the aperture 52 of the shield 46 has a tapered edge 54, as shown in FIGS. 1 and 11.

Mountable over the plate support member 32, is printing pad plunger 56, as shown in FIGS. 1 and 2. The plunger 56 has a support plate 58, which carries four hollow legs 60 and an annular collar member 62, as shown in FIGS. 1 and 2. Extending through the collar member 62 is a plunger stem 64, which connects with a guide plate 66 and a flexible printing pad 68, as shown in FIGS. 1 and 2. The guide plate 66 has four apertures through which the plunger legs 60 pass, to permit a reciprocating plunger movement of the guide plate 66 and the printing pad 68, on such legs 60, as shown or indicated in FIGS. 1 and 2. The plunger stem 64 has a handle 72 mounted thereon and a helical spring 74 mounted therearound between the handle 72 and the collar 62, which spring 74 resiliently biases the plunger stem 64, the guide plate 66, and the printing pad 68, in the upward direction, until downward pressure is applied thereto, as shown or indicated in FIGS. 1 and 2.

Printing material is contained e.g. in a bottle 76, which has a screw cap 78 and a brush 80 coaxially mountable thereon and extending into the bottle 76 to contact the printing material e.g. ink 72, as shown in FIG. 1.

Figure 12:
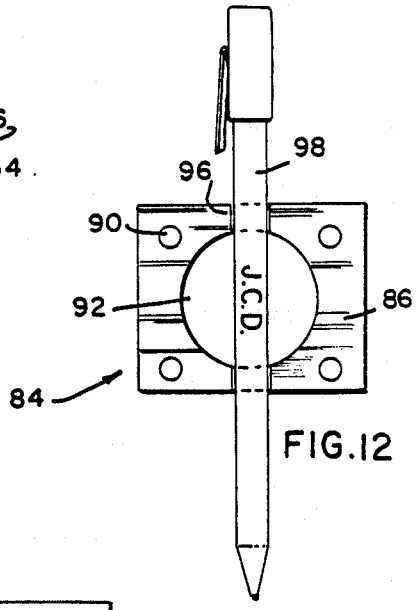
FIG. 12 is a plan view of a component of the invention similar to that shown in FIG. 7.

An article holder 84 having frame member 86 and four legs 88, is surmounted by four indexing pins 90, as shown in FIGS. 1 and 2. The frame 86 has an aperture 92 therein for holding in article, e.g. a golf ball 94 and also has a groove 96, extending on both sides of the aperture 92 for holding other articles e.g. a pen 98, such as shown in FIG. 12.

Figure 8:
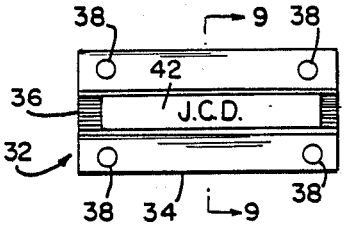
FIG. 8 is a plan view of components of the apparatus embodying the invention shown in FIGS. 1 and 2.
Figure 9:
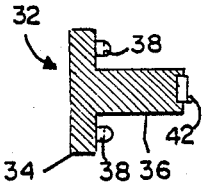
FIG. 9 is a sectional elevation view of the components shown in FIG. 8, taken on lines 9—9, looking in the direction of the arrows.

In another embodiment of the invention, the grooved plate 129, is mounted on a cushion 130 of resilient material e.g. of rubber to form a resilient grooved plate assembly 128 as shown in FIG. 17, which assembly 128 is mounted on plate support member 132, as shown in FIG. 18, in the manner discussed above e.g. with respect to the plate support member 32, shown in FIGS. 8 and 9. The grooved plate 129 can be adhered onto the cushion 130, which in turn can be adhered to the plate support member 132 and so-mounted as indicated, e.g. in FIGS. 18 and 20.

The grooved plate 129 which is desirably made of rigid material e.g. metal and mounted on a resilient cushion of e.g. rubber, is able to resiliently rock under the pressure of the scraper blade 134 on scraper arm 136 as the plate support member 132 and grooved plate assembly 128, move forward in contact with such blade 134, for enhanced scraping or removal of the printing material from the non-grooved surface of the plate 129, as shown in FIGS. 20 and 21. Further, the so resiliently mounted grooved plate 129, is able to flex or pivot sideways as well as fore and aft into close conforming contact with the scraper blade 134, or an angled scraper blade 135, for enhanced scraping removal of the excess printing material, as shown in FIGS. 18 and 19.

In operation, ink is applied by the brush 80 to the surface of the grooved plate 42, including the embossed portion 44. Pressure, e.g. manual pressure is applied to the after end of the scraper arm 30, which raises the scraper blade 22 and provides clearance for sliding the plate support member 32 in the channel 34, under and past the so-raised blade 22. The blade 22 is then lowered by releasing the pressure on the after portion of the arm 30, to lower such blade 22 onto or near the then leading edge 43, of the grooved plate 42, which edge 43 is shown in FIG. 2, and the plate support member 32 is pulled forward in such groove 14 in close contact with the scraper blade 22, to clear the ink off the plate surface 42 while leaving such ink in the grooves 44 e.g. of the letters "J C D." The excess ink 83 is accordingly scraped aft of or off the plate 42 by the blade 22, e.g. as shown in FIG. 2. The so scraped ink can flow over the sides of the plate 42 to descend below the scraped surface for later clean-up as desired, e.g. by a paper towel.

The apertured shield 46 is then positioned over the scraped plate 42 and its support block 36, e.g. as shown in FIGS. 10 and 11, to mask over any ink remnants on the surface outside of the grooved portion and/or to mask over such ink at the perimeter or sides of the plate 42. The printing pad plunger 56, is then positioned over the plate support member such that the hollow legs 60 of the plunger, register over the indexing pins 38 of the support member 34, as shown in FIG. 4.

The plunger handle 72 is then depressed, lowering the printing pad 68 into compressed contact with the apertured shield 46 and the grooved surface 44, to pick up the inked letter pattern, "J C D", therefrom, as shown or indicated in FIG. 3. The plunger handle 72 is then released and the plunger assembly, including the printing pad 68, springs upwardly to its former position above the apertured shield 46 and the grooved surface 44, as shown in FIG. 4.

Figure 7:
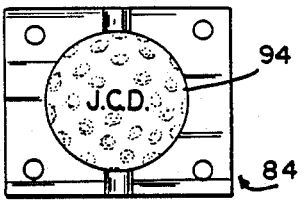
FIG. 7 is a plan view of a component of the apparatus of the invention shown in FIGS. 1 and 2.

The printing pad plunger 56 is then removed from the plate support member 32 and indexed or lowered onto the indexing pins 90 of the article holder 84 and thus automatically centered over the golf ball 94 as shown in FIG. 5. The plunger handle 72 is again depressed lowering and compressing the inked pattern-bearing printing pad 68 against the golf ball 94, printing the pattern thereon, as shown in FIG. 6. The pressure on the plunger handle 72 is released and the plunger assembly including the printing pad 68, springs upwardly of the golf ball 94, as shown in FIG. 5. The resulting golf ball is then printed with the desired ink pattern e.g. "J C D" on golf ball 94 in holder 84, as shown in FIG. 7.

The above described method and apparatus can be employed in printing various articles both flat or two-dimensional and three-dimensional, as indicated. Further the above method and apparatus can be employed in multi-color printing of patterns, designs, or words on articles, due to the use of one or more aperture shields as described above and due to the above-described precise indexing of the plunger assembly of the invention, over the above-described grooved plate and then over the above-described article holder, which indexing is shown e.g. in FIGS. 3, 4, 5, and 6.

Figure 13:
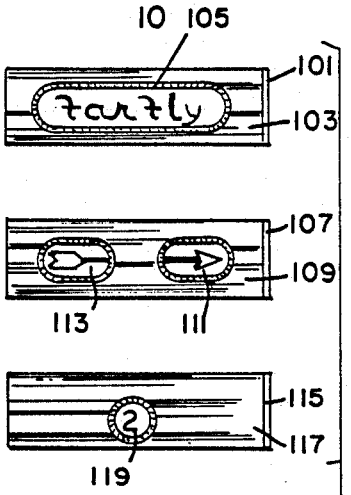
FIG. 13 is a plan view of yet other components of the apparatus embodying the invention.
Figure 14:
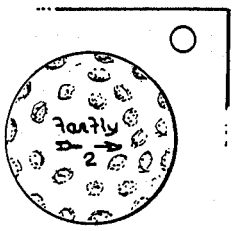
FIG. 14 is a plan view of a component of the apparatus of the invention.

In an example of multi-color printing on three lines on an article a golf ball 93 is printed with the words "Far Fly" in black letters 95 over a blue arrow 97, in turn over a red "2", 99, as shown in FIG. 14. In one procedure according to the present invention, grooved plate 101 bearing the grooved pattern, "Far Fly" is coated with black ink, scraped as described above, e.g. as shown in FIG. 2 and covered with apertured shield 103, having aperture 105 as shown in FIG. 13. A printing pad plunger picks up the ink pattern "Far Fly" and transfers such pattern 95 to the golf ball 93, as described above and illustrated in FIGS. 3, 4, 5, and 6. Then another grooved plate 107, which grooves define an arrow pattern, as shown in FIG. 13, is coated with blue ink, scraped as above described and covered with an apertured shield 109, which has apertures 111 and 113, as shown in FIG. 13. Again the printing pad assembly of the invention picks up the arrow pattern, transfers and prints such pattern 97 on the golf ball 93 as shown in FIG. 14, in the manner described above and shown in FIGS. 3, 4, 5, and 6. Then grooved pate 115 having a grooved pattern of a "2" is coated with red ink and scraped and described above and covered with shield 117 having aperture 119, as shown in FIG. 13. Again the printing pad plunger contacts the inked groove pattern of a "2" and transfers and prints the red numeral "2" as a third line 99, on the golf ball 93, as shown in FIG. 14, according to the method described above and illustrated in FIGS. 3, 4, 5, and 6.

According to the above multi-color ink transfer method, one grooved plate having three lines of grooved patterns thereon and having three shields, e.g. shields 103, 109, and 107 can be employed with one printing apparatus embodying the invention, e.g. as shown in FIG. 1, e.g. with selected application of the desired colored ink into the desired grooves or with cleaning of the desired grooves between application of the desired colored ink. Preferably, however, three separate grooved plates e.g. mounted on their respective plate support blocks are employed in sequence with the scraping assembly of the invention and then the appropriate apertured shield applied over such grooved plate before the ink transfer step indicated in FIGS. 3 to 6. In either procedure the shields, e.g. shields 103, 109 and 117 have apertures which are respectively offset in accord with the position of the respective three lines of grooved pattern. Further, in either procedure, one printing pad plunger can be employed for all ink or die colors since the transfer pad is readily cleaned between each transfer step. Of course more than one printing pad assembly can be employed in such multi-color transfer operation if desired, within the scope of the present invention.

The embossed plate of the invention can be grooved or have raised markings and preferably is grooved for clarity of printing. The embossed plate, such as grooved name-plate 43, having letters thereon 45, as shown in FIG. 15, being narrow of surface and desirably being a rigid surface of e.g. metal, is readily cleared under the pressure of the scraper blade, e.g. as illustrated in FIG. 2. Any stray specks of printing material, e.g. ink that remain on the plate surface outside of the grooves, or at the perimeter or sides of the plate can be masked by the apertured shield 47, having aperture 53 with tapering edges 55, appropriately sized to expose the grooved pattern 45, thereunder, as indicated in FIG. 15.

However, in the case of larger sized grooved plates, e.g. greater than ¼" wide, e.g. for advertising displays on articles of two or three dimensions, such greater widths require a greater scraper blade pressure for effective scraping of the plate surface unless such plate surface can be effectively reduced. Such surface area reduction, e.g. on a wider plate 100, shown in FIG. 16, is accomplished by lowering the elevation of the non-grooved surface 102 to form raised islands 104 and 106 having grooved patterns 108 and 110 respectively thereon into which printing materials such as ink or dye can flow. Then the scraper blade sweeps across such raised islands 104 and 106 only, with the attendant greater pressure, e.g. per sq. cm., being applied by the blade to the effectively reduced grooved plate area. Any ink that collects off the raised island 104 and 106 is readily masked by apertured shield 118, having aperture 124 with beveled edge 126 and aperture 120 with beveled edge 122, which apertures closely fit around and/or partially over such raised island 104 and 106, as indicated in FIG. 16, for transfer printing, as discussed above and illustrated in FIGS. 3 to 6. Again the printing from grooved plate 43 shown in FIG. 15 and grooved plate 100, shown in FIG. 16, can be in one or more colors using one or more shields as discussed above, within the scope of the present invention. For example, one color ink can be applied to raised groove island 106 and another color ink can be applied to raised groove island 104, on the wide plate 100, the scraping means then applied to such raised islands and then the double apertured shield 112 fitted over the perimeter of such islands and the above transfer printing method proceeds, e.g. as shown in FIGS. 3 to 6, to obtain multi-colored printing of an article in a single printing sequence.

Figure 22:
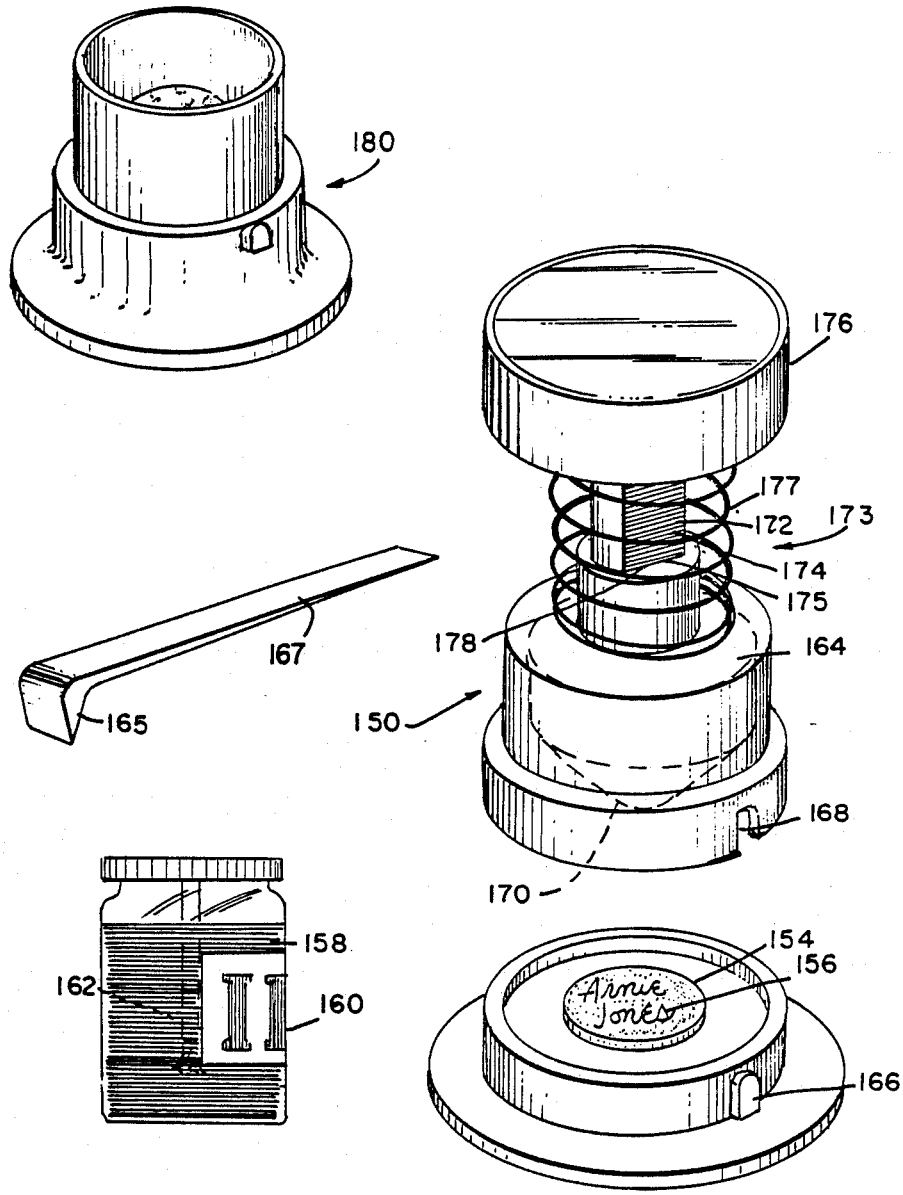
FIG. 22 is a perspective view of another transfer pad printer embodying the present invention.

Referring in detail to FIGS. 22, et seq., the pad plunger assembly 150 is employed with the printing plate holder 152 as shown in FIG. 22. Accordingly, the printing plate 154 having grooved pattern 156 therein and mounted on printing plate holder 152, is coated with ink 158 in blade as discussed above. Such scraper blade is desirably pivotably and resiliently mounted as discussed above, to apply accurate and uniform scraping pressure to the grooved surface. The scraper desirably includes a metal blade e.g. bevelled to a small radius, for clean removal of excess printing material from the embossed surface.

The base of the printing apparatus advantageously includes a channel to direct the movement therein of the embossed surface support member in a straight line, in contact with the scraper blade to further enhance the uniform scraping action and removal of the excess printing material from the embossed surface.

The apertured shield is an important component of the apparatus embodying the invention as it provides that stray printing material particles on the printing plate and/or ink collecting at the perimeter or sides of such plate can be masked from the transfer printing operation of the invention. The shield preferably has apertures having beveled edges to permit close contact through the aperture between the transfer pick-up member and the embossed ink-bearing surface.

The pick-up member is preferably a flexible pad, e.g. of silicon rubber which is highly useful in transfer pad printing. However, other printing material pick-up members can be employed as desired, within the scope of the present invention.

The shield can be of any suitable material and is preferably of plastic or metal and can have one or more apertures therein, preferably tapered as discussed above. The apertured shield serves to mask the embossed surface as previously discussed. The apertured shield has the additional benefit of limiting or preventing sidewise drift of the flexible transfer pad during contact including compression with the embossed surface i.e. during the ink pick-up step, which drift can otherwise occur particularly with smaller transfer pads, resulting in a blurred pattern or image. The apertured shield of the invention accordingly confines the pick-up surface of the transfer pad during ink pick-up to assist the pick-up of a precise pattern or image for transfer and subsequent printing.

Such pick-up member is desirably mounted in a resilient plunger assembly for convenience and rapid operation and further has indexing components for accurate pick-up and deposit of the printing material. However, such plunger and indexing features can be dispensed with and a pad or stamp employed as a basic component within the scope of the invention.

Various article holders can be employed within the scope of the invention, depending upon the article and such article holder can be dispensed with if desired, within the scope of the present invention.

An advantage of the printing method and apparatus of the present invention is that it can be operated with low power requirements e.g. by motor, lever and cam or manually, in contrast with prior art printing machines, which require air compressors, solenoids, and the like in a less versatile operation. In addition, the printing material pick-up member of the invention can be rotated to various positions to print on an article in any desired direction, in contrast with the fixed-track operation of conventional expensive printing machines.

Other features of the transfer printing method and apparatus of the invention is that the embossed surface, e.g. a grooved plate moves relative to and in contact with the scraper means; the scraper means is preferably a spring-loaded blade the bears on an embossed surface mounted on a support member that moves in a channel, to produce a uniform pressure, clean scrape of excess printing material; an apertured shield that fits over the so-scraped embossed surface that ensures a clean pick-up and transfer of the printing pattern as well as the capability of multi-line, multi-color transfer printing, provided by the method and apparatus of the invention.

Further the invention provides a low cost transfer printing apparatus which can be mass produced at relatively low-cost and enables the printing identification of numerous articles, e.g. the ball-point pens at one's place of employment, to reduce the disappearance and replacement cost thereof.

Streamlined Transfer Printing

Another embodiment of the method and apparatus of the invention follows:

ADDITIONAL SUMMARY

Broadly the present invention further provides a printing apparatus for printing a pattern on articles comprising: a holder having a transfer pad mounted thereon, a member having a three-dimensional pattern thereon and means to apply printing material to the pattern. Means are further provided to contact the pad with the pattern to pick up the so-patterned printing material on the pad and means for contacting the pad with an article to print the pattern on the article.

Also provided is a method for printing a pattern on two and three dimensional articles comprising applying printing material to a three dimensional pattern, contacting the pattern with a transfer pad to pick up the so-patterned printing material on the pad and contacting the pad with an article to print the pattern on the article.

By "three dimensional pattern" as used herein, is meant raised or grooved pattern on or in a surface or a combination thereof.

The printing material herein can be any suitable printing material as previously discussed which is applied to a three dimensional pattern as previously discussed.

DESCRIPTION OF FURTHER PREFERRED EMBODIMENT

Referring in detail to the above reference further drawings, the pad plunger assembly 150 is employed with the printing plate holder 152 as shown in FIG. 22. Accordingly, the printing plate 154 having grooved pattern 156 therein and mounted on printing plate holder 152, is coated with ink 158 in ink bottle 160, by ink brush 162, as indicated in FIG. 22. Upon deposit of the ink 158 on the printing plate 154, a scraper blade 165 having handle 169 is passed over the printing plate 154 in close contact therewith to clear the ink from such plate while distributing the ink 158 in the grooved pattern 156, as indicated in FIG. 22.

Figure 24:
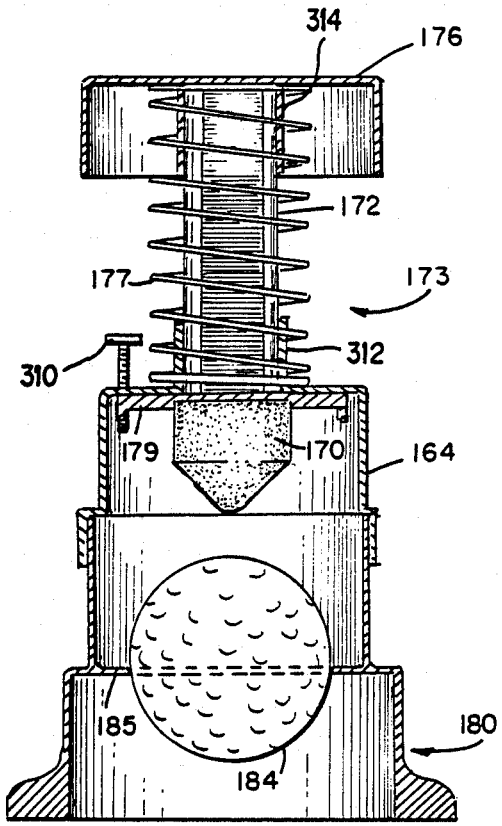
FIG. 24 is a partial sectional elevation view of the printing apparatus shown in FIG. 23.

The pad plunger assembly 150, is lowered onto the plate holder 152 such that the plate holder tab 166 engages the tab-receiving recess 168 in the pad plunger housing 164, as indicated in FIG. 22. The pad plunger assembly and plate holder are accordingly indexed for accurate and reproducable ink pattern pick-up and subsequent transfer. The transfer pad 170 is mounted in the plunger housing 164 on a plunger stem 172 having a flat or key way side 174, which stem connects with the plunger handle 176, as shown in FIGS. 22 and 24. The plunger stem 172 passes through a closely fitting aperture 175 in the plunger housing 164, including a flat key-way portion 178, which prevents rotation of the plunger stem 172 and the printing pad 170 as indicated in FIG. 22. The plunger 173 (including plunger stem 174 and transfer pad 170) moves against the helical spring 177, as shown in FIG. 22.

In operation, with the pad plunger assembly 150 indexed on the printing plate holder 152, the plunger 173 is depressed contacting the pad printer 170 with the ink pattern 156 of the printing plate 154, to transfer such pattern onto the pad 170. The plunger handle 176 is then released, permitting the plunger 173 to rise off the printing plate 154 to pick up the pattern thereon as indicated in FIG. 22.

The pad plunger assembly 150 is then lifted off the printing pad holder 152 and positioned atop the article e.g. golf ball, holder 180, as shown in FIG. 23. The plunger housing 164 is rotated relative to the golf ball holder 180 until the plunger housing recess 168 fits over and mates with the article holder tab 182 as shown in FIG. 23, which indexes the pad plunger assembly 150 including the plunger housing 164, the plunger 173 and the transfer pad 170 in a precise position relative to the golf ball holder 180 as shown or indicated in FIGS. 23 and 24. The golf ball 184 in held in place in the holder 180 by annular flange 185, which defines a golf ball holding aperture therein.

The plunger handle 176 is depressed against the helical spring 177 which lowers the transfer pad 170 and its ink pattern into contact with the golf ball 184 to print same as shown or indicated in FIGS. 23 and 24. The plunger handle 176 is released and the plunger 173 springs upwardly of the golf ball 184 to the position shown in FIG. 23.

The above ink pattern pick-up on the transfer pad and subsequent deposition thereof on the golf ball can be repeated as desired with precise positioning of subsequent printing steps on said golf ball as desired, due to the indexing features of the respective plunger and holder components as discussed above.

A golf ball with a clearly defined printing pattern thereon e.g. printed golf ball 186 with printed pattern 188 thereon is obtained as shown in FIG. 23.

The plunger stroke and transfer pad compression and deformation can be controlled and limited, e.g., so that the pad contacts the pattern on the printing plate but does not deform into contact with (or over) the edge of the plate, to pick up surplus or peripheral ink. Accordingly, the plunger stroke can be controlled by extending or shortening the axial length of the plunger collar 314 and/or the housing collar 312, shown in FIG. 24 for pad deformation limitation.

Further an adjustable plunger stop, eg, screw stop 310, mounted on the plunger housing 164 as shown in FIG. 24, can control the plunger stroke and the compression and deformation of the plunger pad.

Figure 25:
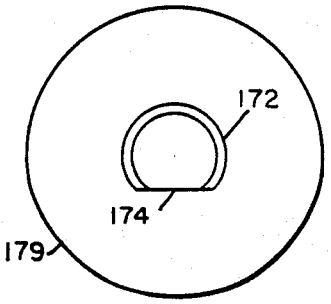
FIGS. 25 and 26 are respectively, a plan view and sectional elevation view of a component of the printing apparatus embodying the invention shown in FIGS. 23 and 24.
Figure 26:
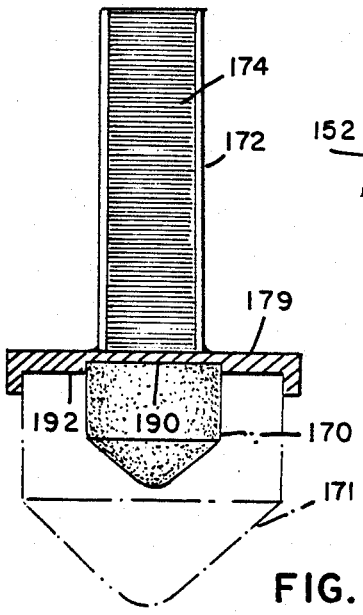

The plunger stem 172 has a flat key-way side 174, as previously discussed, which plunger stem 172 terminates in a pad-holding plate 179 as shown in FIGS. 24, 25, and 26. The pad-holding plate 179 has a smaller recess 190 and a larger recess 192 so as to hold respectively, a smaller transfer pad 170 or a larger transfer pad 171 as illustrated in FIG. 26.

Figure 27:
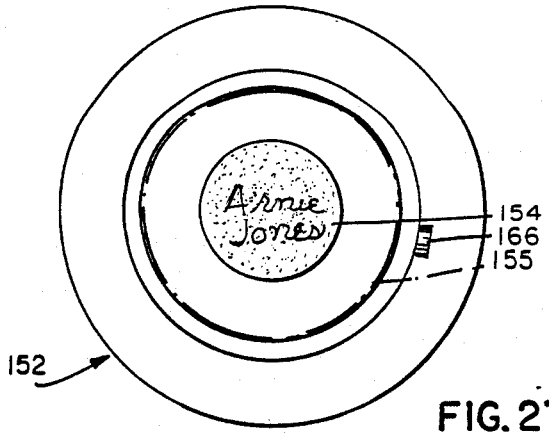
FIGS. 27 and 28 are respectively, a plan view and a sectional-elevation view of a component of the printing apparatus embodying the invention shown in FIG. 22.
Figure 28:
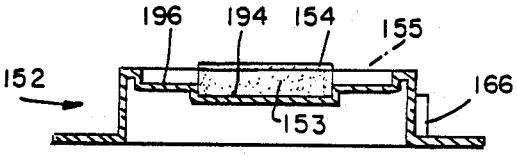

In addition, the printing plate holder 152 has a minor recess 194 to hold small printing plate 154 (on a tape or sponge tape adhesive layer 153) and major recess 196 to alternatively hold a larger printing plate 155, as shown in FIGS. 27 and 28.

Figure 29:
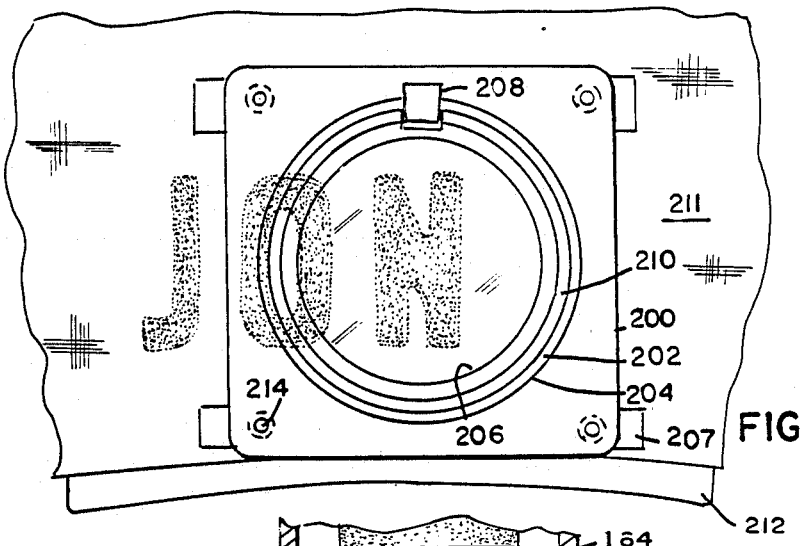
FIG. 29 is a plan view of another component of the printing apparatus embodying the invention.
Figure 30:
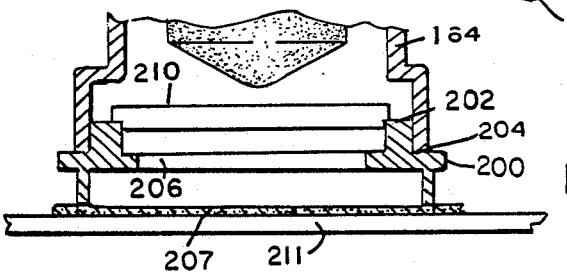
FIG. 30 is a sectional-elevation view of the component shown in FIG. 29.

In another embodiment of the invention the golf ball holder 180 is replaced by an apertured frame 200 having an upstanding rim 202, an annular shoulder 204, and an aperture 206 therein, as shown in FIGS. 29 and 30. An indexing tab 208 is mounted adjacent the rim 202 of the frame 200, as shown in FIG. 29.

In operation, the apertured frame 200 is placed upon the surface to be printed, e.g. a sheet of plastic wood or paper or a fabric such as a T-shirt. A printing plate such as plate 154, shown in FIG. 22, is inked and scraped to provide a grooved ink pattern in such plate as discussed above. A plunger assembly 150, is indexed on the plate holder e.g. plate holder 152, shown in FIG. 22 and the plunger 173 and transfer pad 170 thereof, lowered into contact with the inked plate 154 to pick up an ink pattern therefrom. The pattern-bearing pad 170 and plunger assembly 150 are then lifted off the printing plate holder and lowered onto the apertured frame 200 mounted e.g. on a T-shirt and secured thereon by double backed adhesive tape 207 or by a clamp (not shown) and the plunger 173 and pad 170 are indexed by slot 168 on said frame on the tab 208 in the manner discussed above, and the pad is lowered into contact with the T-shirt to print e.g. the letter N thereon, as indicated in FIG. 29. The plunger assembly 150 is then lifted off the apertured frame 200 to perform the next printing cycle.

Figure 31:
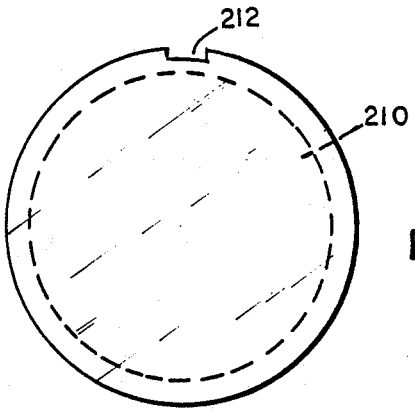
FIG. 31 is a plan view of an auxiliary member employed with the component of the invention shown in FIGS. 29 and 30.
Figure 32:
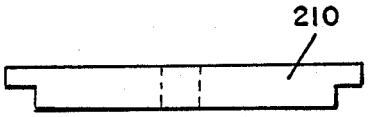
FIG. 32 is an elevation view of the auxiliary member shown in FIG. 31.

Advantageously a transparent shield 210 having a tab engaging recess 212 such as shown in FIGS. 31 and 32, is positioned atop the apertured frame 200, to temporarily shield the surface below from the printing pad, as indicated in FIGS. 29 and 30.

The printing shield 210 is an important feature of this embodiment of the present invention in that the pattern-bearing transfer pad can be pressed into contact therewith to print the pattern thereon to afford the operator a preview of the alignment and location of the pattern e.g. the letter N shown in FIG. 29, before such shield is removed and the letter is actually printed on the surface below the apertured frame 200. Accordingly if the letter N on the shield 210 is improperly spaced from the previously printed letter on the underlying surface or fabric, the apertured frame and so-printed shield can be moved or adjusted until the correct spacing and positioning of the shield-printed letter is determined. Thereafter the apertured frame is secured on the fabric or underlying surface 211, the shield is removed and the printing pick up and deposit steps repeated, to print the letter (or other pattern) in the desired location on the fabric or surface 211, as indicated in FIG. 29. Advantageously, the apertured frame 200 is moved over the surface 211 on a guide, such as guide member 212, to assist the positioning of the apertured frame over the fabric or surface to be printed.

If desired the transparent shield 210 can be omitted within the scope of the present invention.

Figure 33:
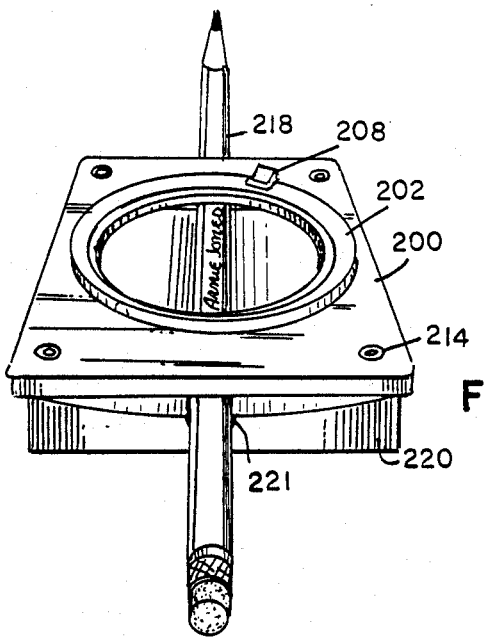
FIG. 33 is a perspective view of a component of the invention related to that shown in FIG. 29.
Figure 34:
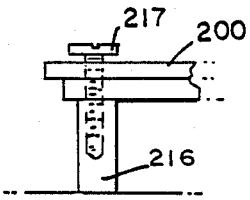
FIG. 34 is a fragmentary sectional-elevation view of a component of the invention related to that of FIGS. 29 and 30.

The apertured frame 200 desirably has spaced openings 214 therein, to permit the mounting thereof on end supports 220 having a groove 221 therein for supporting a pen or pencil 218 as shown in FIG. 33, thereon below said frame for printing thereon by the transfer pad by the steps discussed above. Alternatively legs 216 of any desired length can be mounted to the openings 214 in the apertured frame, by threaded fasteners 217 as indicated in FIG. 34, to raise such frame above a surface for placing an article to be printed therebetween.*

*In another embodiment indexing pins (not shown)(similar to pins 90 of FIG. 1) can be inserted into the openings 214 of the aperture frame 200 of FIG. 29, to index the hollow legs 60 of the pad plunger 56, shown in FIGS. 1 and 2.

Figure 35:
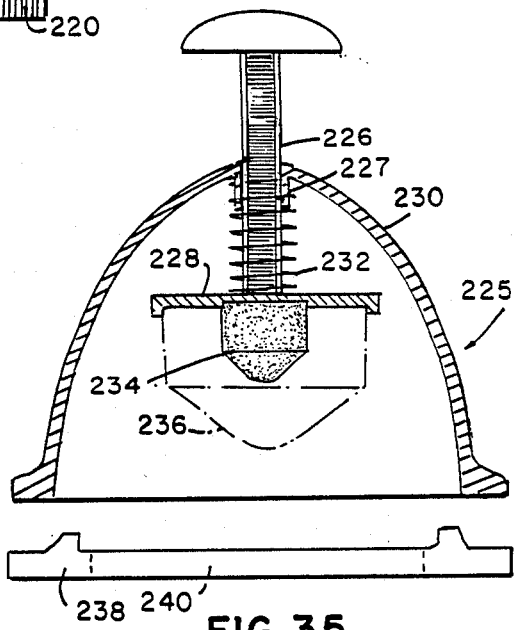
FIG. 35 is a sectional-elevation view of yet another transfer pad printer embodying the present invention.

In another embodiment of the printing apparatus of the invention, the plunger assembly 225 includes a plunger stem 226 connected to transfer pad holder 228 mounted in the plunger housing or bell 230, as shown in FIG. 35. The plunger stem 226 has a flat side or keyway and moves in a closely conforming collar 227 within the bell 230. A feature of this plunger assembly is that the helical spring 232 is mounted around the plunger stem 226, inside of the plunger housing or bell 230 and is accordingly out of view, as shown in FIG. 35. In this embodiment, the spring 232 extends when the plunger is depressed rather than compressing. The pad holder 228 can hold various size transfer pads such as small pad 234 and large pad 236 as indicated in phantom in FIG. 35. The bell 230 is mountable on apertured frame 238 having an aperature 240 therein for printing on articles mounted below such frame as discussed above.

Figure 36:
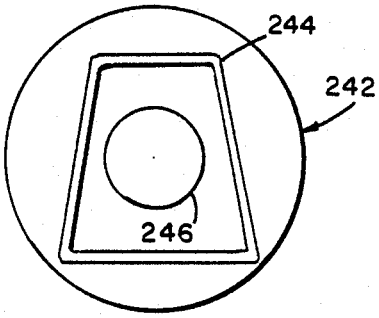
FIGS. 36 and 37 are plan views of other components of printing apparatus embodying the present invention.
Figure 37:
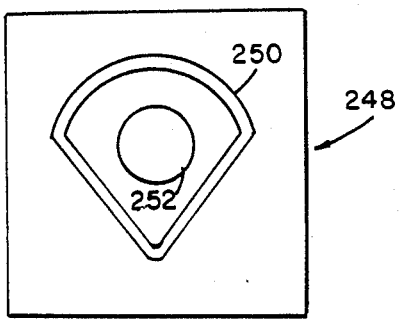

In another embodiment of the invention, indexing of the respective components of the printing apparatus of the invention is accomplished by cross-sectional shaping of such components for a one-position fit. For example, printing plate holder 242 has an upstanding trapezoidal rim 244 enclosing the printing plate 246 as shown in FIG. 36. Similarly, printing plate holder 248 has an upstanding pie-shaped rim 250, enclosing a printing plate 252, as shown in FIG. 37. In each case the plunger housing and the article holder or apertured frame (not shown) have corresponding cross-sectional shapes which fit or index in but one position, over the respective trapezoidal or pie-shaped components, so that indexing thereof is accomplished without the need of a projecting tab and matching recess, if desired, within the scope of the invention. It will be seen that various other asymmetrical, cross-sectional shapes for the respective printer components can be employed to obtain dependable indexing thereof within the scope of the invention.

In addition to indexing, locking of matching printer components can be obtained e.g., by adding extension aperture 169 to plunger housing aperture 168, as shown in phantom in FIG. 23, so that upon placing the plunger housing 164 over the golf ball holder 180, the holder tab 182 enters the housing aperture 168 and then by twisting such housing relative to the holder, the holder tab 182 slides into such aperture extension 169 to lock the plunger housing and golf ball holder together, before during and after the plunging and printing step on the golf ball 184, as indicated in FIG. 23. Such tab and aperture extension locking mechanism can be employed also between plunger housing and printing plate holder, e.g., shown in FIG. 22 and between plunger housing and apertured frame e.g., shown in FIGS. 29 and 35, within the scope of the invention.

Figure 38:
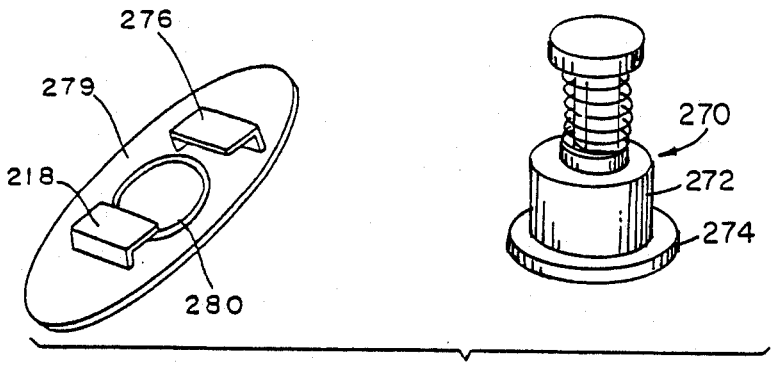
FIG. 38 is a perspective view of still another transfer pad printer embodying the present invention.

In another embodiment of the printing apparatus of the invention, the plunger and pad holder assembly 270 has a plunger housing 272, which housing has an annular flange 274 which flange fits under and between a pair of indexing brackets 276 and 278, mounted on an apertured frame 279, having an aperture 280 below which frame can be mounted either a pattern-bearing printing plate or an article to be printed (not shown), as indicated in FIG. 38. In operation, the plunger assembly 270 is inserted sidewise between the indexing brackets 276 and 278, which brackets engage the sides and top of the plunger flange 274, to lock and index the plunger in place over the aperture 280, for precise ink pattern pickup or deposit in the manner described at length above.

Figure 39:
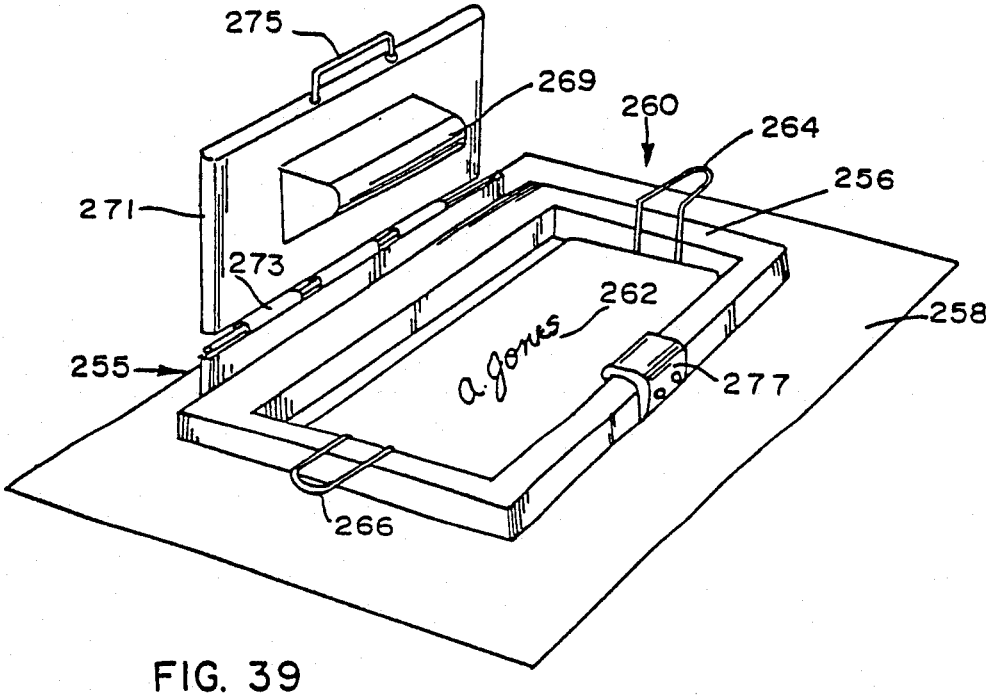
FIG. 39 is a perspective view of again another transfer pad printer embodying the present invention.

In another embodiment of the invention, the transfer printing apparatus 255 has an apertured frame 256, which rests upon the surface of fabric 258 to be printed, as shown in FIG. 39. A printing plate 260, having grooved pattern 262 and support arms 264 and 266, is inked and scraped by means previously described, to obtain an inked three dimensional pattern, as indicated in FIG. 39. The so-inked printing plate 260 is then placed in the apertured frame 256, above the surface to be printed as shown in FIG. 39 and a transfer pad 268 mounted upon a hingeable support lid 271, is pivoted into contact with such inked pattern to pick up such pattern and then lid and pad are swung to the open position, as indicated in FIG. 39. The printing plate 260 and its arms 264 and 266, are removed from the apertured frame 256, exposing the fabric or surface to be printed 258 therebelow, within such frame. The pattern-bearing pad 268 and hingeable lid 271 are again pivoted on hinge 273 to contact such pad with the fabric or surface to print such ink pattern thereon. For prolonged or pressurized contact between pad and ink pattern or pad and fabric or surface, the hingeable lid 271 has a lock arm 275 which engages a latch member 277 mounted on the apertured frame, as shown in FIG. 38. Such printing apparatus provides accurate indexing and one or more patterns can be repeatedly and accurately printed on the underlying surface 258 as desired. It may be well to clear the pad e.g., with a paper towel between each printing cycle if necessary, within the scope of the invention.

Figure 40:
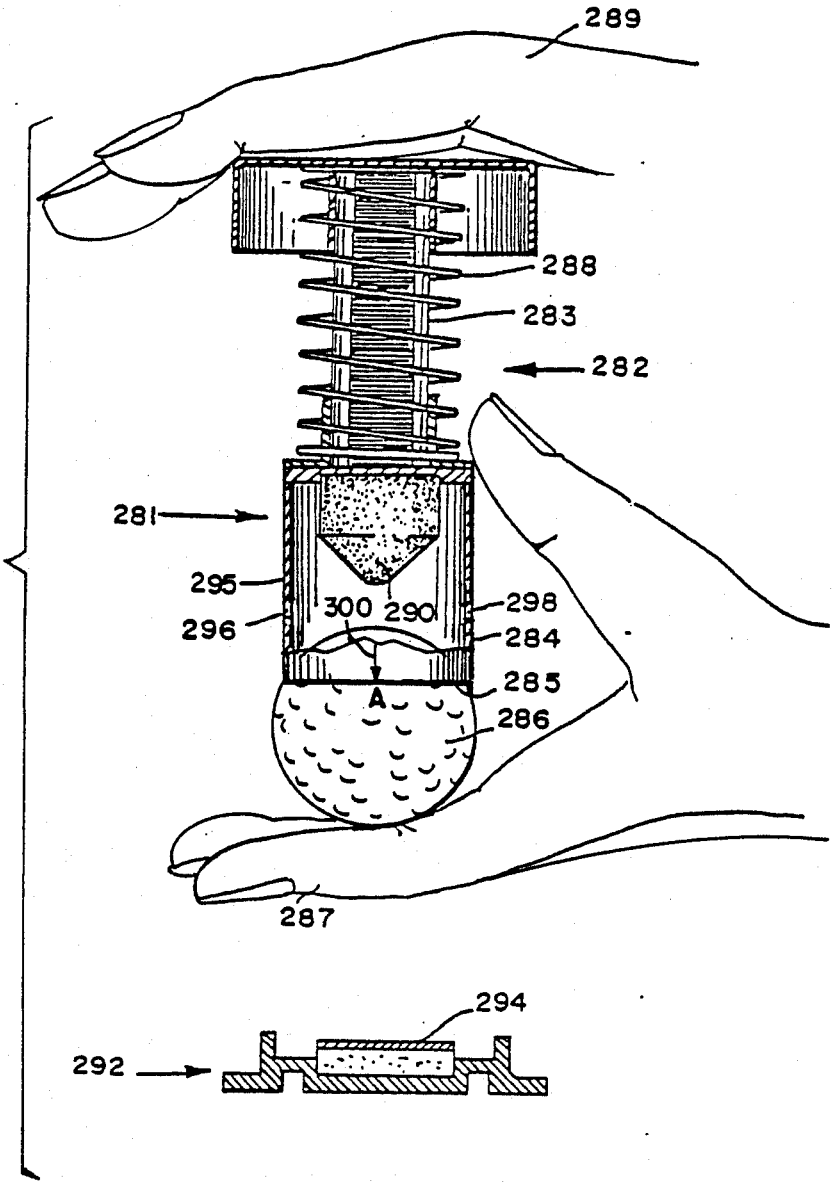
FIG. 40 is a sectional elevation view of another printing apparatus embodying the present invention.

Advantageously, the barrel 295 of the plunger assembly 281, shown in FIG. 40, has one or more indexing markers thereon, e.g. arrow 300 which can be proximate to or spaced from the plunger housing rim 285, which can be aligned or oriented with a marking on the golf ball 286 or other article to be printed, for accurate repeat indexing and reprinted on such article. Alternatively, markings or features on the plunger assembly 281, can be employed as such indexing mark, e.g. the flat side of the plunger stem or an edge thereof, or other marking on such plunger assembly 281, or an indentation, projection or other marking on the plunger housing rim 285, or by other markings, features, irrregularities, aperatures and the like which serve as such indexing mark.

A similar indexing mark can be placed on the printing plate holder 292 for indexing of the plunger pad 290 and printing plate 294 shown in FIG. 40.

Accordingly, the plunger assembly 281, with its rim 285 and indexing mark 300, can accurately index the golf ball or other article for precise repeat printing steps, e.g. to darken the pattern printed thereon, or to print added colors in a precise pattern onto the golf ball or other article without requiring an article holder as shown in FIG. 40.

Further, according to the present invention, all of the above embodiments can be provided with matching or indexing marks on the plate holder, plunger and article holder, in place of tabs, pins, slots, hollow legs and the like.

The plunger assembly 281 can also be employed to print on various other articles having a rounded, angular or flat shape as desired. Further a pencil or pen can be positioned through the appertures 296 and 298 in the plunger housing, for printing thereon by the transfer pad 290, as indicated in FIG. 40. Further the plunger housing rim 285, can be rounded or angular in cross-section or have any other convienient shape and be open or continuous to engage various other shaped articles for printing thereon.

In the above embodiment the article holder is dispensed with and the plunger housing is shaped to engage an article and serve as the article holder in combination with an auxiliary support member on the opposite side of the article such as the hand or a support surface as discussed above.

Accordingly the present invention provides method and apparatus for readily and quickly printing articles of flat or three dimensional shapes in one or more colors, on one or more lines, in a precise low-cost manner.

The printing apparatus of the invention can be made of various rigid materials and preferably is made of metal or plastic or a combination thereof.

The embossed surface is preferably a grooved surface, e.g. a grooved plate made of a rigid material such as plastic or metal and preferably of metal.

The grooved pattern in such surface can be of any desired configuration, e.g. letters, a designed or a design or a combination thereof, formed in any suitable manner in such surface or plate e.g. in the case of certain metal plates, by etching the desired pattern.

The grooved surface, e.g. a grooved plate is desirably mounted on a support member e.g. in a groove atop a support block, which plate can be permanently or replaceably mounted to such support block in any desired manner.

The printing material removal means is preferably a scraper blade as discussed above. Such scraper blade is desirably pivotably and resiliently mounted as discussed above, to apply accurate and uniform scraping pressure to the grooved surface. The scraper desirably includes a metal blade e.g. bevelled to a small radius, for, clean removal of excess printing material from the embossed surface.

Relative to FIGS. 1 and 2, the base of the printing apparatus advantageously includes a channel to direct the movement therein of the embossed surface support member in a straight line, in contact with the scraper blade to further enhance the uniform scraping action and removal of the excess printing material from the embossed surface.

The apertured shield is an important component of the apparatus embodying the invention as it provides that stray printing material particles on the printing plate and/or ink collecting at the perimeter or sides of such plate can be masked from the transfer printing operation of the invention. The shield preferable has apertures having beveled edges to permit close contact through the aperture between the transfer pick-up member and the embossed ink-bearing surface.

The pick-up member is preferably a flexible pad, e.g. of silicon rubber which is highly useful in transfer pad printing. However, the printing material pick-up members can be employed as desired, within the scope of the present invention.

Relative to FIGS. 1 and 15, the shield can be of any suitable material and is preferably of plastic or metal and can have one or more apertures therein, preferably tapered as discussed above. The apertured shield serves to mask the embossed surface as previously discussed. The apertured shield has the additional benefit of limiting or preventing sidewise drift of the flexible transfer pad during contact including compression with the embossed surface i.e. during the ink pick-up step, which drift can otherwise occur particularly with smaller transfer pads, resulting in a blurred pattern or image. The apertured shield of the invention accordingly confines the pick-up surface of the transfer pad during ink pick-up to assist the pick-up of a precise pattern or image for transfer and subsequent printing.

Such pick-up member is desirably mounted in a resilient plunger assembly for convenience and rapid operation and further has indexing components for accurate pick-up and deposit o the printing material. However, such plunger and indexing features can be dispensed with and a pad or stamp employed as a basic component, within the scope of the invention.

Various article holders can be employed within the scope of the invention, depending upon the article and such article holder, can be dispensed with if desired, within the scope of the present invention.

An advantage of the printing method and apparatus of the present invention is that it can be operated with low power requirements e.g. by motor, lever and cam or manually, in contrast, with prior art printing machines, which require air compressors, solenoids and the like in a less versatile operation. In addition, the printing material pick-up member of the invention can be rotated to various positions to print on an article in any desired direction, in contrast with the fixed-track operation of conventional expensive printing machines.

Relative to FIGS. 1, 2, 20 and 21, other features of the transfer printing method and apparatus of the invention is that the embossed surface, e.g. a grooved plate moves relative to and in contact with the scraper means; the scraper means is preferably a spring-loaded blade the bears on an embossed surface mounted on a support member that moves in a channel, to produce a uniform pressure, clean scrape of excess printing material; an apertured shield that fits over the so-scraped embossed surface that ensures a clean pick-up and transfer of the printing pattern as well as the capability of multi-line, multi-color transfer printing, provided by the method and apparatus of the invention.

Further the invention provides a low cost transfer printing apparatus which can be mass produced at relatively low-cost and enables the printing identification of numerous articles, e.g. the ball-point pens at one's place of employment, to reduce the disappearance and replacement cost thereof.

The above embodiments of the invention, beginning with FIG. 22, provide a light-weight, compact, readily indexible printer to print various patterns on various shaped articles, e.g. golf balls, pens, T-shirts, sheet material and the like.

The operation of the printer of the invention as shown and described with respect to FIGS. 3, 4, 5 and 6 applies to the operation of the above embodiments of the invention beginning with FIGS. 22 et seq.

Two variations on the previous disclosure are noted. One is that, in addition to the pivotal scraper shown e.g. in FIG. 1 hereof, a hand-held scraper e.g. scraper 167, shown in FIG. 22, can be employed to clear the printing plate and ink the grooves thereof, e.g. shown in FIG. 22. Further, while an apertured shield can be employed to mask the edges of a printing plate, e.g. plate 154 shown in FIG. 22, it has been found that with clean scraping of the printing plate and careful sizing of the transfer pad so that upon compression thereof it does not contact the edges of the printing plate, that such apertured shield can be omitted, at least in the case of the embodiments of the invention of FIGS. 22 et seq, if desired. However an apertured shield which masks the edges of such printing plate can be helpful and is employed relative to the above embodiments if desired.

An inventive to simplifying the printing plate scraper and omitting the apertured shield if possible, is the providing of a low cost pad printing embodiment such as shown in FIGS. 22 et seq.

Although the printing plate holder, the transfer pad plunger and the article holder are shown in FIG. 22 et seq to be rounded or cylindrical, other shapes including angular as well as rounded or a combination thereof as well as asymmetrical in cross-section, can be employed and such components can be of relatively continuous surface e.g. as shown in FIGS. 22 and 23 or can be open i.e. have a plurality of apertures therein if desired, within the scope of the present invention.

The respective components of plate holder, pad plunger assembly and article holder, can index by one or more tabs or projections in corresponding apertures as previously discussed. Further, such components can be shaped cross-sectionally at the point of contact therebetween for a one-position fit and index accordingly, as discussed above. Also the plunger assembly of the invention can mount between indexing brackets on an apertured member, a printing plate holder and/or an article holder, is a side-wise coupling or indexing, as previously discussed. The above components of the printing apparatus of the invention can also lock together while indexing in the manner discussed above.

The printing apparatus of the invention can print or reprint an article in one or more colors or patterns by repeating the ink pick-up and printing steps described above, due to the accurate indexing features provided the pad plunger assembly of the present invention.

The plate holder can hold various sized printing plates and patterns therein and the pad plunger can hold various sized printing pads therein as, described above.

The printing apparatus of the invention can, as discussed, print a single pattern on a two- or three-dimensional surface and can also print a series of patterns e.g. letters or other patterns on a surface, employing a preprinting shield for alignment purposes where desired, in the scope of the present invention.

The transfer pad of the invention is desirably mounted on a plunger assembly as discussed above. However such transfer pad can also be mounted on a pivotable or hingeable assembly as discussed above. Preferably however, the transfer pad is mounted on an indexable plunger assembly as disclosed above.

The plunger assembly is preferably governed by resilient means which can be mounted in view, outside of the plunger housing or out of view, inside of the plunger housing as discussed above. Preferably a helical spring serves as the resilient means but various other resilient means can be employed as desired inthe scope of the present invention, such as a foam rubber collar mounted around the plunger shaft in place of the helical spring illustrated herein.

In still another embodiment of the printing apparatus of the invention, plunger assembly 281 has pad plunger 282 and the plunger housing 284, which is sized to directly engage at the rim 285 thereof, an article such as golf ball 286, as shown in FIG. 40. The plunger 282 includes the plunger stem 283, helical spring 288, and transfer pad 290, as shown in FIG. 40. The plunger assembly 281 is sized to fit over the holder 292 of the printing plate 294 for ink pattern pick-up on the transfer pad 290, as indicated in FIG. 40.

In operation the printing pad 294 having a grooved pattern therein (not shown) is inked and scraped. The plunger assembly 281 is then mounted atop the printing plate holder 292 and the plunger 283 depressed to contact the transfer pad 290 with the ink pattern of the printing plate 294. The plunger 283 is released and the transfer pad 292 springs upwardly thereof, carrying the inked pattern thereon. The plunger assembly is then placed in contact with an article, e.g.,a golf ball 286, as shown in FIG. 40; the plunger 283 is again depressed and prints said pattern on the golf ball 286. In this simplified embodiment, the plunger assembly 281 is held in one hand 289 against the golf ball 286, which is supported either by the other hand 287 or any convenient surface such as a bench, a table, the ground or any other convenient surface.

What is claimed is:

1. An apparatus for transfer pad printing comprising a printing plate having a surface with a grooved pattern therein, means to apply ink on said surface and in said grooved pattern, means to remove the ink from said surface while leaving it in said grooved pattern, a separate unconfined and freely movable portable pad holder having a transfer pad mounted thereon, which pad holder is a resiliently mounted plunger which is completely detached from said printing plate, manual means to contact said pad with the grooved surface to pick up the inked pattern thereon, means to remove the so-inked pad from the grooved surface and manual means to contact said pad with an article to print said pattern thereon, said printing plate being mounted in a plate holder having a first indexing means and said plunger having a second indexing means to engage said first indexing means and permit the accurate indexing of said plunger and pad with said plate holder and pattern.

2. The apparatus of claim 1 wherein said article is mounted in an article holder detached from said pad holder and said article holder has an indexing guide thereon for accurate and reproducible positioning of said transfer pad thereon.

3. The printing apparatus of claim 1, wherein said grooved surface is grooved in a pattern and recessed outside of said pattern to reduce the contact area of said surface with said removal means.

4. The printing apparatus of claim 1, wherein said plate is resiliently mounted.

5. The printing apparatus of claim 1, wherein said plate is metal and mounted on a resilient member.

6. The printing apparatus of claim 1, wherein the means to apply ink is a brush.

7. The printing apparatus of claim 1, wherein the ink removal means is a scraper blade.

8. The printing apparatus of claim 1, having an apertured shield and means to position said shield over a portion of said printing plate while exposing said grooved pattern after its contact with the ink removal means and before its contact with said transfer pad.

9. The printing apparatus of claim 8, wherein said shield has an aperature therethrough surrounded by reduced tapering thickness of the shield body.

10. The printing apparatus of claim 1, wherein said transfer pad is flexible.

11. The printing apparatus of claim 10, wherein said transfer pad is resiliently mounted for spring-back after being contacted with said pattern or said article.

12. The printing apparatus of claim 1, wherein said transfer member is freely movable and upon pick-up of the so-patterned printing ink, can be rotated to print said pattern on an article in any desired direction.

13. The printing apparatus of claim 1 having a holder for said article adapted to hold articles including a golf ball and a pen for printing thereon.

14. The apparatus of claim 1 wherein said plunger is resiliently mounted in a plunger housing and reciprocates in a guideway in said plunger housing, said guideway having a key-way therein to prevent rotation of said plunger and said pad around the plunging axis thereof.

15. The apparatus of claim 1 wherein said ink is deposited on said printing plate and the ink removal means is a scraper blade which is moved across said printing plate to remove ink from its surface while leaving ink in said grooved pattern.

16. The apparatus of claim 1 wherein said printing plate is mounted in a plate holder having an indexing tab thereon, said plunger is resiliently mounted in a plunger housing and the plunger housing has a tab receiving aperature therein to engage said tab and permit the accurate indexing of said plunger and pad with said plate holder and pattern.

17. The apparatus of claim 16 wherein said article is mounted in an article holder and said article holder has an indexing tab thereon sized to engage the tab receiving aperature in said plunger housing for accurate indexing of said plunger and pad with said article holder for accurate printing of said article.

18. The apparatus of claim 2 wherein said article holder is an appertured frame, which frame is positioned on an article surface for indexing of said plunger therewith and printing said pattern on said article surface upon contact with the pattern-bearing pad.

19. The apparatus of claim 18 wherein said apertured frame is mounted on a fabric which rests on a surface.

20. The apparatus of claim 19 wherein said apertured frame is secured in place on said fabric by adhesive tape means.

21. The apparatus of claim 18 having a transparent shield which fits over the aperture of said frame to permit a trial printing of said pattern thereon for visual orientation thereof relative to said article surface or fabric below.

22. The apparatus of claim 21 wherein said transparent shield has an indexing contour thereon to permit indexing thereof on said frame.

23. The printing apparatus of claim 17 wherein said plunger housing has an aperture extending sidewise from the indexing tab receiving aperture to permit shifting of such tab into such aperture extension to index and lock the plunger housing to said plate holder or said article holder bearing the indexing tab.

24. The printing apparatus of claim 1 wherein said article is mounted in or under a detached article holder, said plunger is mounted in a plunger housing and the engaging portion of said plunger housing, said plate holder and said article holder are matching but asymmetrical in cross-section, to permit but one orientation or indexing when said plunger housing is mounted on said plate holder or on said article holder.

25. The printing apparatus of claim 2 wherein said article is mounted in or under an article holder and has and indexing member which includes a pair of indexing brackets mounted on opposed sides of an aperture therein for movement therethrough of said plunger, and wherein said plunger is mounted in a plunger housing, said brackets postioned so as to flank the plunger housing and extend partially over a portion of such housing when the plunger housing is inserted between such brackets, to index and lock the plunger housing in place over said aperture for ink pattern pick-up or deposit.

26. The printing apparatus of claim 1 in which said plunger stem extends through a housing, said plunger stem supporting a transfer pad within such housing, said stem and transfer pad being constrained by a resilient member mounted within said housing to provide a resilient plunger assembly with the resilient member out of view.

27. The printing apparatus of claim 26 wherein said resilient member is mounted to said plunger stem and said housing outside of said housing to provide a plunger assembly with the resilient means in view.

28. The printing apparatus of claim 1 wherein the plunger wherein said plunger is resiliently mounted in aplunger housing, which housing has a portion shaped to directly engage an article to be printed.

29. The printing apparatus of claim 28 wherein said plunger housing terminates in a rounded rim sized to directly engage a golf ball for printing thereon.

30. The apparatus of claim 1, wherein said plunger is resiliently mounted in plunger housing, which apparatus has an adjustable plunger stop mounted on said plunger housing to control the plunger stroke, compression and deformation of the transfer pad.

31. The apparatus of claim 1, wherein said plate holder has a plurality of indexing projections thereon and said plunger has a plurality of hollow members with projection receiving apertures therein, to engage said projections and permit accurate indexing of said plunger and pad with said plate holder and pattern.

32. The apparatus of claim 31, wherein said article is mounted in an article holder and said article holder has indexing projections thereon sized to engage the projection receiving apertures in the plunger hollow members for accurate indexing of said plunger and pad with said article holder for accurate printing on said article.

33. The apparatus of claim 32 having as an article holder, an apertured frame, which frame is positioned on an article surface for indexing of said plunger therewith and printing said pattern on said article surface upon contact with the pattern-bearing pad.

34. The apparatus of claim 33, wherein said apertured frameis mounted on a fabric which rests on a support surface.

35. The apparatus of 34, wherein said apertured frame is secured in place on said fabric by adhesive tape means.

36. The printing apparatus of claim 1 wherein said plunger is resiliently mounted in a plunger housing, which housing has a portion shaped directly to engage an article to be printed, said plunger housing having an indexing mark thereon to be oriented relative to a mark on said article to be printed, to index said article fro accurate reprinting thereon.

37. The printing apparatus of claim 36, wherein said plunger housing terminates in a rounded rim sized to directly engage a golf ball for printing thereon.

38. The printing apparatus of claim 36 wherein said plunger housing has as an indexing mark, at least one aperture or notch therein.

39. The printing apparatus of claim 36, wherein said printing plate holder is provided having an indexing mark thereon.

40. The printing apparatus of claim 1 wherein said plunger is resiliently mounted in a plunger housing, which housing has a portion shaped directly to engage an article to be printed.

41. The printing appartus of claim 40, wherein said plunger housing terminates in rounded rim sized to directly engage a golf ball for printing thereon.

* * * * *